United States Patent [19]

Frank et al.

[11] 4,178,841

[45] Dec. 18, 1979

[54] AIR VENT

[75] Inventors: Gerhard Frank, Wilnsdorf-Obersdorf; Eckhard Kucharczyk, Netphen, both of Fed. Rep. of Germany

[73] Assignee: Siegenia-Frank AG., Siegen, Fed. Rep. of Germany

[21] Appl. No.: 872,317

[22] Filed: Jan. 25, 1978

[30] Foreign Application Priority Data

Jan. 27, 1976 [DE] Fed. Rep. of Germany ..... 2703207

[51] Int. Cl.[2] ..... F24F 13/18; F24F 7/00

[52] U.S. Cl. ..... 98/98; 49/277; 49/357; 98/41 R; 98/106; 98/DIG. 10; 251/251; 251/319

[58] Field of Search ..... 98/98, 99 R, 99.1, 99.2, 98/99.3, 99.4, 99.5, 99.6, 99.7, 99.8, 118, 102, 106, 41, DIG. 10; 49/308, 357, 324, 277; 220/345; 251/251, 252, 318, 319

[56] References Cited

U.S. PATENT DOCUMENTS

| | | | |
|---|---|---|---|
| 1,704,571 | 3/1929 | Linz | 98/98 |

FOREIGN PATENT DOCUMENTS

| | | | |
|---|---|---|---|
| 279874 | 1/1914 | Fed. Rep. of Germany . | |
| 319203 | 3/1920 | Fed. Rep. of Germany . | |
| 1249489 | 9/1967 | Fed. Rep. of Germany | 98/41 R |
| 1958413 | 5/1971 | Fed. Rep. of Germany | 49/324 |
| 1377858 | 9/1964 | France | 98/41 AV |
| 1210222 | 10/1970 | United Kingdom | 98/98 |

*Primary Examiner*—William F. O'Dea
*Assistant Examiner*—Harold Joyce
*Attorney, Agent, or Firm*—Norman S. Blodgett; Gerry A. Blodgett

[57] ABSTRACT

Air vent consisting of a fixed, gridlike apertured front panel and a stop plate disposed behind it, which plate is movable by a control mechanism in the direction of its plane and to the plane of the front panel and which plate in a position resting against the back of the front panel closes the grid apertures, but which in a separated position opens the grid apertures of the front panel for the passage of air.

11 Claims, 11 Drawing Figures

AIR VENT

BACKGROUND OF THE INVENTION

Ventilation appliances of this type have long been part of the state of art as taught by German Pats. No. DT-PS 279 874 and No. DT-PS 319 203 . The relative motion of the baffle or stop plate against the front panel has been brought about by lever gears. Because of the use of these lever gears, the known ventilation appliances can be manufactured only with relatively short longitudinal dimensions, because only then can it be assured to some extent that they achieve an adequate sealing in the closed position of the stop plates. To be sure, in German Pat. No. DT-AS 1 249 489 the proposal has already been made to provide ventilation appliances having a considerable length relative to their width, i.e., so-called "slot" ventilators, with a baffle plate that is movable transversely of its plane and to the plane of the perforated or slotted front panel. In that case, the movement of the baffle plate is controlled by a steering knuckle arm disposed in the manner of a parallelogram, so that (for the purpose of transverse motion) there is also superimposed on the stop plate a longitudinal motion. The actual adjusting motion for the stop plate is derived from a crank assembly which is pivotally mounted at the front panel for movement about an axis that is oriented transversely of its plane, the crank pin having a length such that the stop plate can move along it during its transverse motion.

An essential disadvantage of all known ventilation appliances of this type lies in the fact that the mounting of the levers and handles having to do with the control mechanism can only be provided at the front panel and the stop plate at quite definite locations. This, however, not only limits the attainable sealing effect in closed position of the ventilation appliance, but also its structural length cannot be selected arbitrarily to correspond to various needs. It is, therefore, an outstanding object of the invention to provide air vent which eliminates the disadvantages characteristic of the known ventilation appliances of this type.

Another objection of this invention is the provision of air vent of this type of construction whose main component parts can be manufactured as standard elements that can be subdivided into random lengths, and wherein, after assembly, a uniformly-tight seal is assured at all parts of the baffle plate lying against the front panel.

With these and other objects in view, as will be apparent to those skilled in the art, the invention resides in the combination of parts set forth in the specification and covered by the claims appended hereto.

SUMMARY OF THE INVENTION

In general, the invention consists of an air vent in which the control mechanism has at least one thrust rod which is adjustable parallel to the longitudinal edges of the front panel and linearly movable in guides thereof. Beside the trust rod lies a flange which extends along the entire length of the stop plate and which is essentially oriented transversely of its plane. Distributed over the length of the thrust rod and the flange are provided adjusting elements consisting of studs and of oblique slide slots for engaging them. Holders are provided on the front panel in which the stop plate is mounted for transverse movement only.

The essential construction parts of a ventilation appliance of the defined type, including the front panel, baffle plate, and thrust rods, can be manufactured in a simple manner as components extruded from light metal or plastics. The thrust rods and the front panels can be equipped, while taking into account defined latch dimensions, with the studs and slide slots which together act as the adjusting elements. It is necessary then only to cut these component parts to the desired specific length from the standard elements and then, after assembly, to press them into one another.

One type of construction of the ventilation appliance of the invention is characterized by the fact that the baffle plate is swingably mounted at the back of the front panel for movement about a pivot at the longitudinal edge that lies opposite the flange. In this case, the pivot can simply be formed, for example, by providing the stop plate is provided at the longitudinal edge that lies opposite the flange with a thickened bead of circular cross-section, while the front panel has at its rear surface a generally C-shaped undercut slot. The stop plate bead can simply be pushed into the slot.

Another embodiment of the ventilation appliance which forms the basis of the invention is characterized by the fact that, there is provided an adjustable thrust rod parallel to each longitudinal edge of the front panel and that each longitudinal edge of the stop plate carries a flange. Between these parts are provided adjusting elements consisting of studs and slide slots. In this case the stop plate is moved by simultaneous actuation of the two thrust rods transversely of its plane against the front panel.

It has been found particularly advantageous that the studs of the adjusting elements are fixed to the thrust rods, while the oblique slide slots are provided in the flanges of the stop plate, but an arrangement in reverse manner is also readily feasible.

A high natural stability of the ventilation appliance results in accordance with the invention, when the front panel as well as the stop plate consists of a profiled section of U-shaped cross-section, wherein undercut profiled grooves are integrally molded onto the inside surfaces of the flanges of the front panel as guides for the thrust rods, while the flanges of the stop plate contain the oblique slide slots.

According to another developmental feature of the invention, perforated or slotted grid apertures are stamped from the web of the front panel, while the web of the stop plate is provided on the one hand with superposed or pressed-out protuberances that fit into the grid apertures and has on the other hand cutouts that lie beside the protuberances offset from the grid apertures of the front panel. Because the protuberances engaging the grid apertures of the front panel in the closed position of the stop plate, there is achieved not only an excellent seal, but also an esthetically satisfying appearance of the ventilation appliance, especially in the aspect which faces the room. Because the perforations in the stop plate are arranged to be non-coextensive with the grid apertures of the front panel, there is achieved in the opened state of the ventilation appliance a good sound-absorbing effect, since the sound waves do not have a direct passage.

A further improvement of the sealing effect in the closed position of the ventilation appliance can be achieved, if in accordance with the invention the edges of the grid apertures in the front panel or the edges of the protuberances on the stop plate are provided with sealing elements, preferably of an elastic material.

According to the invention, the thrust rods are also connected at least at one end to a slide plate that has a recess for engagement with a drive crank or a drive eccentric. The drive crank or the drive eccentric, respectively, can hereby be mounted in a plate that is adjustable and locked in a grid aperture of the front panel.

It is also suggested that the flanges of the stop plate be equipped with transverse slots into which engage and hold the guide cams that are located at the flange inside of the front panel. The guide cams can rest on holding shoes which can be pressed into the undercut profiled grooves of the front panel and which can be fixed therein by clamp bolts or the like.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
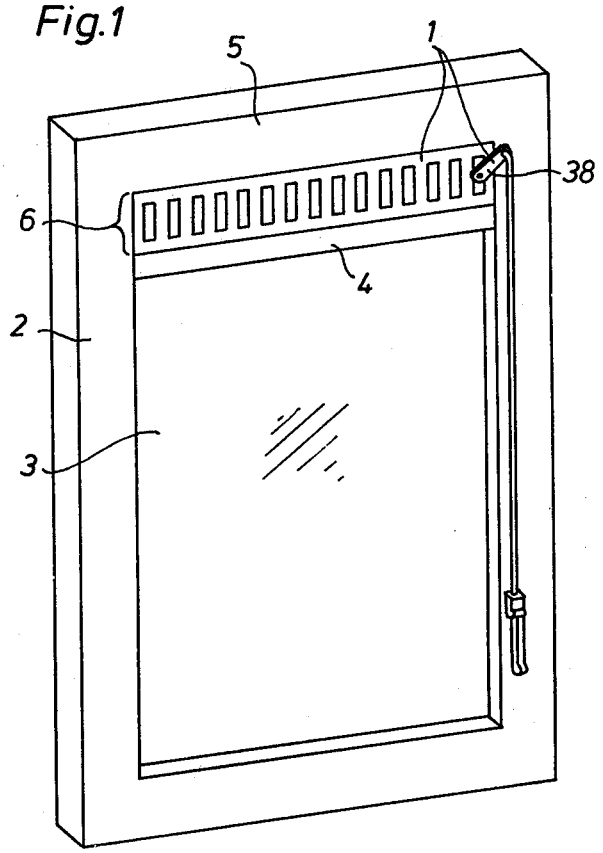
FIG. 1 is a perspective view of an air vent built into a glass-enclosed window.

FIG. 1 of the drawing shows as an example of the installation of the ventilation appliance of the invention on a window 2 with glass panes, whereby the top edge of a glass pane 3 is held by a so-called springer 4. Between the springer 4 and the top transverse rail 5 of the window frame is formed a horizontal ventilation gap 6, into which is inserted the air vent 1.

Figure 2:
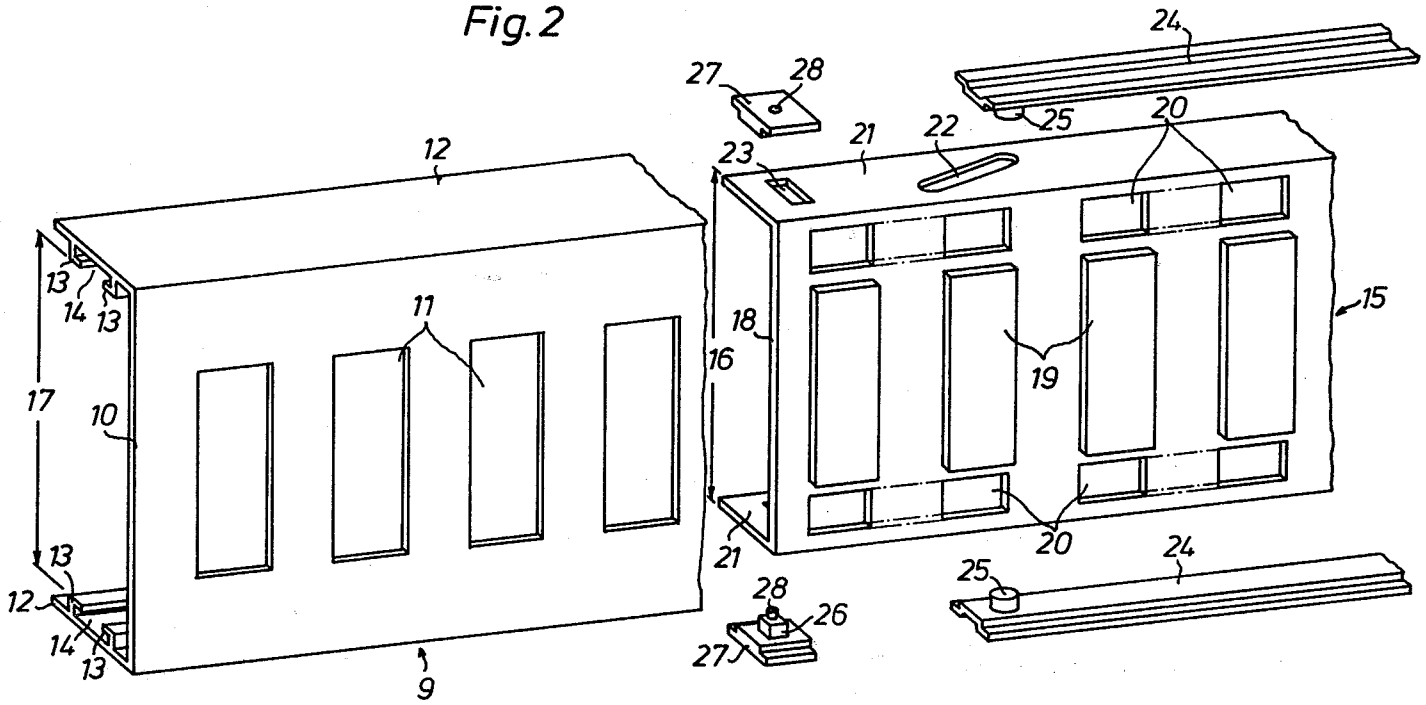
FIG. 2 is an exploded perspective view of the essential component parts for a first embodiment of the air vent.
Figure 5:
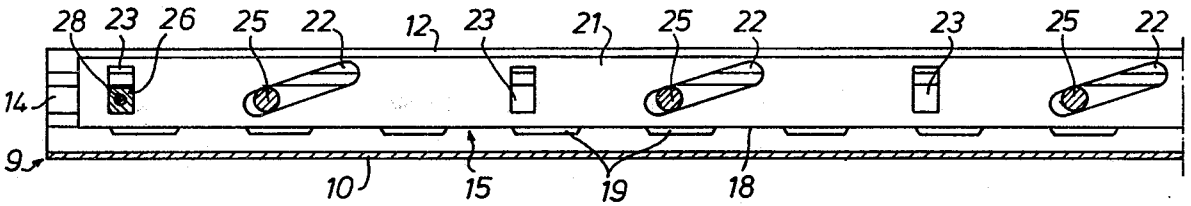
FIG. 5 is a section view of the air vent taken on the line V—V of FIG. 4.
Figure 9:
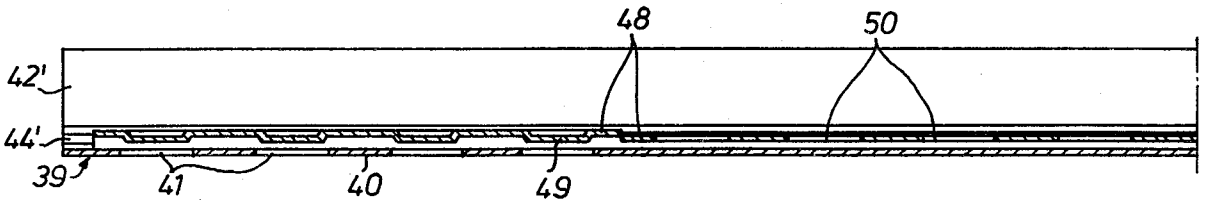
FIG. 9 is a longitudinal sectional view of the air vent taken on the line IX—IX of FIG. 8.
Figure 6:
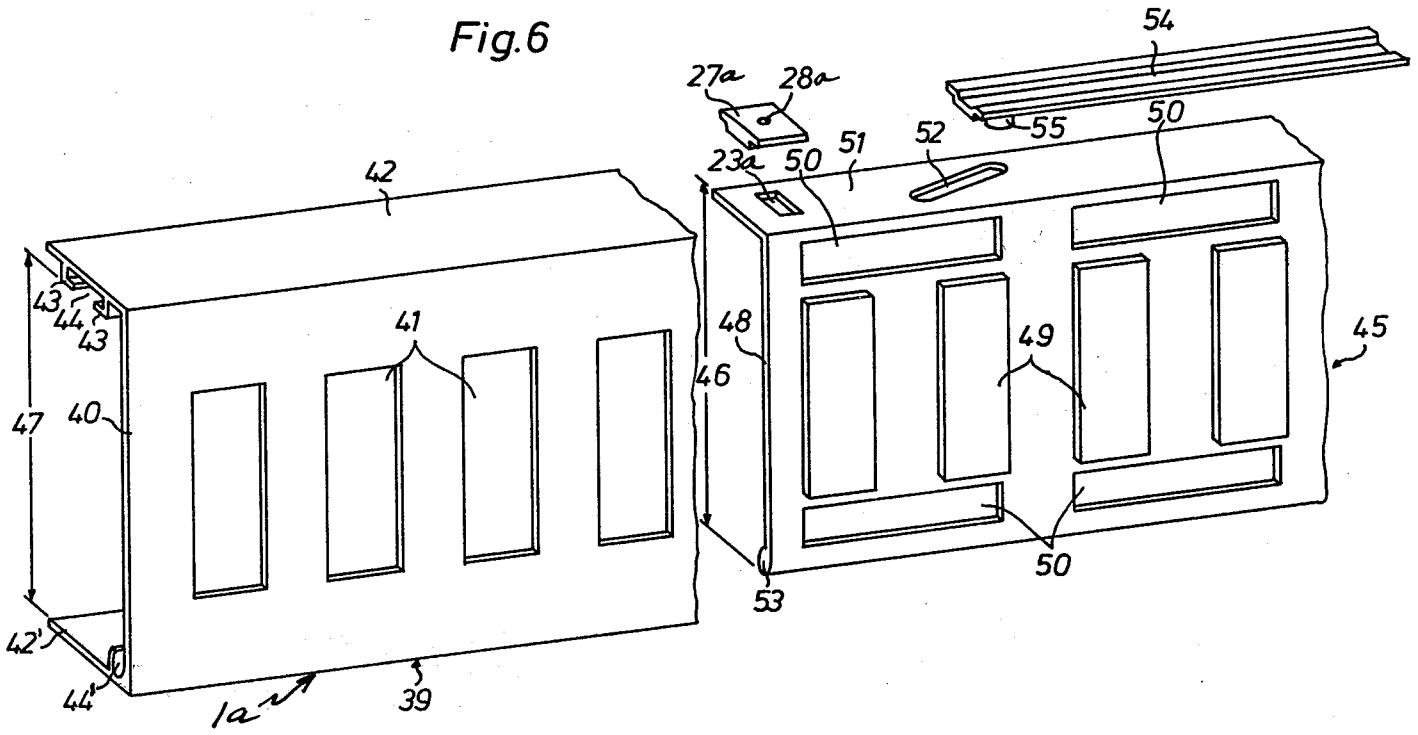
FIG. 6 is an exploded perspective view of the air vent of the invention.

A preferred embodiment of the ventilation appliance of the invention is illustrated in FIGS. 2 to 5. FIG. 2 shows the constructional development of the individual components of which the air vent 1 is composed.

A front panel 9 fabricated of light metal or plastics in the form of an extruded section displays an essentially U-shaped cross-section. From the web 10 of the front panel 9 are stamped equally-spaced air passages 11, e.g., of rectangular shape lying side-by-side. At the inside of the two flanges 12 is formed an undercut profiled groove 14 by means of hook-like, integrally molded profiled sections 13 which groove extends in longitudinally of flanges 12.

A baffle or the stop plate 15, which likewise is a U-shaped cross-section, is used as additional structural component. The width 16 of this stop plate 15 is slightly narrower than the inside distance 17 between the profiled parts 13 provided on the inside surface of the two flanges 12 of the front panel 9 and they serve to limit the profiled groove 14.

The web 18 of the stop plate 15 carries protuberances 19 at its outside, the protuberances being arranged equidistantly in side-by-side relationship. They are pressed from the material of the web 18. Their shape and size matches the air passages 11 of the front panel 9. Above and below of each of these protuberances 19 are provided air passages 20 stamped from the web 18 of the stop plate 15.

In both flanges 21 of the stop plate 15 are located slide slots 22 which lie obliquely of the plane of the plate, these slide slots 22 being also disposed at a predetermined latch distance from one another.

Transverse slots 23 are also located in the flanges 21 and these are preferably so arranged that a transverse slot 23 always lies between two successive slide slots 22.

In FIG. 2 are further illustrated two thrust rods 24 which have a profile cross-section that fits into the undercut profiled grooves 14 of the front panel 9. On these thrust rods 24 are mounted studs 25 at a latch interval from one another which matches the latch distance between the oblique slide slots 22 in the stop plate 15.

To the stop plate 15 finally belong also guide cams 26 which rest on foot parts 27 whose cross-section corresponds at least approximately to the cross-section of the thrust rods 24. Each of the guide cams 26 is brought into engagement with a transverse slot 23 of the stop plate 15, while the foot parts 27 are pushed into the undercut profiled grooves 14 of front panel 9. By means of a clamp bolt 28 the foot parts 27 as well as the guide cams 26 can be locked in the profiled grooves 14 of front panel 9.

The front panel 9, stop plate 15, and the thrust rods 24 are made available in the form of standard elements from which profiled sections can be cut in any desired length.

Figure 3:
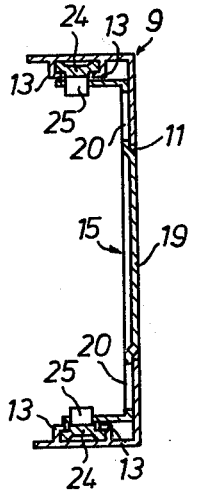
FIG. 3 is a transverse sectional view of the air vent in closed condition.
Figure 4:
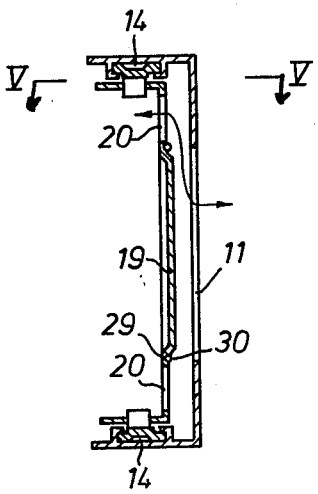
FIG. 4 is a transverse sectional view of the air vent in open condition.

For assembling the air vent, the guide cams 26 are inserted from the outside of flanges 21 into the transverse slots 23 located near the end of stop plate 15 in such a way that their foot parts 27 face away from the outside of the flanges 21. In addition, the thrust rods 24 are brought from the outside of flanges 21 through their studs 25 into engagement with the oblique slide slots 22. Therefore, the stop plate 15 can be pushed in the longitudinal direction into the front panel 9 in such a way that (on the one hand) the foot parts 27 of guide cams 26 and (on the other hand) the thrust rods 24 glide into the undercut profiled grooves 14 of the front panel 9. Care must hereby be taken that the protuberances 19 provided on the web 18 of stop plate 15 always come to rest exactly behind the air passages 11 in web 10 of front panel 9. When this is the case, the guide cams 26 are locked by means of the clamp bolt 28 through their foot parts 27 in the undercut profiled grooves 14 of front panel 9. This results in the structural arrangement that is shown in FIGS. 3 and 4 of the drawing. Because the guide cams 26 engage the transverse slots 23 of stop plate 15, the result is that the stop plate 15 can no longer shift in the longitudinal direction relative to front panel 9. Therefore, when the thrust rods 24 move in the undercut profiled grooves 14 of front panel 9 this causes the studs 25 to engage the oblique slide slots 22 of the stop plate 15, so that the stop plate 15 shifts transversely only of its plane and transversely of the plane of the front panel 9, between the closed condition shown in FIG. 3 and the open condition illustrated in FIG. 4.

In the closed position of the air vent 1 the stop plate 15 comes to rest with its web 18 against the back surface of the web 10 of the front panel 9, as is evident in FIG. 3. The protuberances 19 of the stop plate 15 enter the air passages 11 of the front panel 9, so that their outer surface is in the plane of the outer surface of front panel 9. In that way, the passage of air through the ventilation appliance 1 is blocked, because the air passages 20 of the stop plate 18 are also closed through abutment at the back of web 10 of front panel 9.

The sealing effect of the air vent 1 can be further improved, for example, by inserting a bead 29 running around the protuberances 19 a packing cord 30 of elastic, such as plastics or rubber, that lies against the rim edges of the air passages 11 of front panel 9.

In the open position of the air vent 1, the stop plate 15 occupies the position evident from FIG. 4 relative to the front panel 9. This means that the stop plate 15 is lifted from the back of front panel 9 by a predetermined dimension, so that (on the one hand) the air passages 11 in front panel 9 and (on the other hand) the air passages 20 in stop plate 15 are freed. Since the air passages 11 and 20 occupy a position where they are non-coextensive with one another, an uninterrupted view through the ventilation is avoided and a certain sound-absorbing effect is also effected.

Since the oblique slide slots 22 in the flanges 21 of stop plate 15 and the studs 25 on the thrust rods 24 are provided with a uniform dividing graduation, a uniform parallel shift of stop plate 15 relative to front panel 9 over the whole length of the ventilation appliance 1 is effected when the two thrust rods 24 are simultaneously and uniformly displaced in the undercut grooves 14 of the front panel 9. This is particularly true in the closed condition of the air vent 1, because good sealing depends on this.

Figures 7, 8, 10, 11:
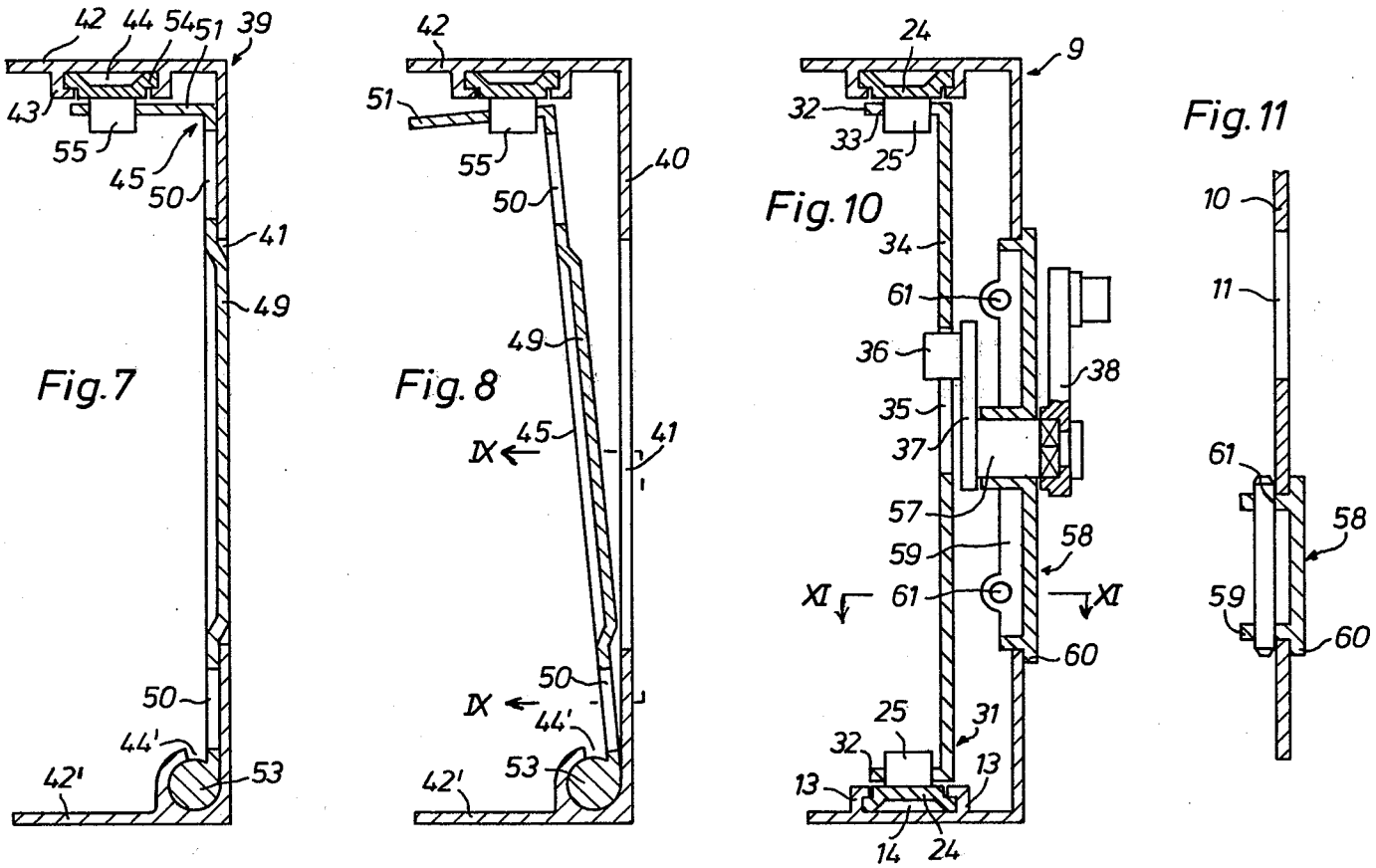
FIG. 7 is a transverse sectional view of the air vent of FIG. 6 in closed condition.
FIG. 8 is a transverse sectional view of the air vent in open condition.
FIG. 10 is a transverse sectional view of the air vent showing a possible embodiment of the adjusting elements for its actuation.
FIG. 11 is a sectional view taken on the line XI—XI of FIG. 10.

The simultaneous and uniform actuation of the two thrust rods 24 is brought about, because they are interconnected at least at one end by a slide plate 31 which is illustrated in FIG. 10. This slide plate 31 has, for example, a U-shaped cross-section and is provided in each of its two flanges 32 with holes 33 which can be made to engage at least one stud 25 each of the two thrust rods 24.

The slide plate 31 moves in the longitudinal direction of the front panel 9 between the profiled parts 13 at the two flanges 12 of front panel 9 which limit the undercut profiled groove 14. In the web 34 of the slide plate 31 is located a slotted hole 35 running transverse to the slide direction which is engaged by the crank pin 36 of a crank arm 37. The latter is pivotally mounted at the back of web 10 of the front panel 9 and can be displaced, for example, by a swivel arm 38 lying at the outside of the front panel. The motion of the crank arm 37 brings about a longitudinal displacement of the slide plate 31 relative to front panel 9 and, therefore, a corresponding longitudinal shifting of the thrust rods 24. This in turn brings about, through their studs 25 and the slide slots 22 of the stop plate 15, a transverse shifting of the plate relative to the front panel 9. The manner in which the transverse shift of the stop plate 15 is accomplished by the interaction of the studs 25 and the oblique slide slots 22 is shown clearly in FIG. 5 of the drawing. This shows that the stop plate 15 is locked against a longitudinal shift relative to the front panel 9 by guide cams 26 and transverse slots 23. Therefore, by the longitudinal shift of the studs 25 by means of the thrust rods 24 through the slide slots 23, a transverse displacement of stop plate 15 is brought about.

FIGS. 6 to 9 of the drawing illustrates an air vent 1*a* which is distinguished not only constructionally, but also in its function from the air vent 1 of FIGS. 2 to 5. In this case the front panel 39 is also formed of an extruded profile section of light metal or plastics with an essentially U-shaped cross-section. The web 40 of this front panel 39 is equipped with air passages 41. Only the top flange 42 displays at its inside surface the hook-like profile parts 43 which define between themselves an undercut profiled groove 44. The bottom flange 42' of the front panel 39, however, is equipped in the corner region near the web 40 with an approximately C-shaped undercut profiled groove 44'.

The baffle or stop plate 45 has an essentially angular cross-section and has a width 46 that is adapted to the inside width 47 of front panel 39. The longer leg 48 of the stop plate 45 carries on its outside surfaces protuberances 49 which in form and shape are adapted to the air passages 41 in front panel 39. Above and below these protuberances 49 there are further provided air passages 50. The smaller leg 51 of the stop plate 45 shows the oblique slide slots 52 which lie at a predetermined latch distance from one another in the longitudinal direction. By means of the slots the studs 55 which are arranged at a corresponding latch distance on a thrust rod 54 can be brought into engagement, whereby the thrust rod 54 is guided in the undercut profiled groove 44 of the front panel 39 is longitudinal motion.

On the other longitudinal edge of the stop plate 45 is molded bead 53 of circular cross-section that can be inserted into the C-shaped undercut profiled groove 44' of front panel 39 in the longitudinal direction. This forms a hinge-like support between the front panel 39 and the stop plate 45 in such a way that, in case of a longitudinal motion of the thrust rod 54 in the undercut profiled groove 44, there is produced by the studs engaging the slide slots 52, a swing of the stop plate 45 relative to front panel 39. In the closed position evident in FIG. 7 of the air vent 1*a*, the stop plate 45 lies with its broader leg 48 against the back surface of the web 40 of the front panel 39 and thus seals the ventilation appliance against the passage of air. In the open position of the air vent 1*a* of FIG. 8, on the other hand, the stop plate 48 is obliquely folded away from the front panel 39, so that the air passages 41 and 50 are all freed for the passage of air.

The assembly of the air vent 1*a* constructed in accordance with FIGS. 6 to 9 can be carried out in a manner similar to that of the air vent 1 of FIGS. 2 to 5 by the simple insertion of the interacting functional components. Locking of the practically flap-like stop plate 45 against longitudinal motion relative to front panel 39 can be practically carried out in the same manner as in the case of the ventilation appliance of FIGS. 2 to 5, namely by a guide cam fixed by a foot part and a clamp bolt in the undercut profiled groove 44, the cam engaging in a transverse slot located at the narrower leg 51 of front plate 45.

The cost of construction of the air vent of FIGS. 6 to 9 is lower than that of the air vent of FIGS. 2 to 5, because only one thrust rod is needed and also because the slide plate of FIG. 10 can be omitted.

In FIGS. 10 and 11 it can also be seen that it is possible to arrange the crank arm that serves as adjusting means for the motion of the stop plate 15 in one of the air passages 11 of the front panel 9. Therefore, the crank arm 37 which carries the crank pin 36 is journaled with its shaft 57 in a plate 58 that has a socket 59 and a flange 60. The socket 59 has a contour which fits exactly into one of the air passages 11, while the flange 60 supportingly overlaps the edge of the passage at the outside surface of the front panel 9.

The socket 59 is equipped with holes 61 which are parallel to the plane of web 10 of the front panel 9 and through which can be pushed bolts after the socket 59 has been inserted in the air passages 11. The ends of the bolts project laterally beyond the socket 59 and, thus, securely overlap the edges of the air passages 11 at the back of the web 10 of the front panel 9.

Setscrews or the like may be also used in place of the safety bolts, the setscrews being normally fully screwed into the holes 61 and for the purpose of safety extend through and out of the holes.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Air vent consisting of a fixed, gridlike apertured front panel and of a stop plate disposed behind it, which is movable by a control mechanism transversely of its plane and to the plane of the front panel, which stop plate in a position resting against the back of the front panel closes the grid apertures, but which in a position raised therefrom opens the grid apertures of the front panel for the passage of air, characterized by the fact that the control mechanism has at least one thrust rod (24, 54) that is adjustable parallel to the longitudinal edges of the front panel (9, 39) and that is linearly movable in guides (13, 14, 43, 44) thereof, beside which lies a flange (21, 51) extending over the entire length of the stop plates (15, 45) and essentially oriented transversely of their plane, and that adjusting elements are provided distributed along the length of the thrust rod (24, 54) and of the flange (21, 51), the adjusting elements consisting of studs (25, 55) engaging oblique slide slots (22, 52), and that holders (26, 27) are provided at the front panel (9, 39) holders, so that the stop plate (15, 45) is fixed in such a way that it is movable only in an transverse direction.

2. Air vent according to claim 1, characterized by the fact that the stop plate (45) is mounted for limited swinging movement at the back of the front panel (42) about pivots (44', 53) at the longitudinal edge that lies opposite the flange (51).

3. Air vent according to claim 1, characterized by the fact that parallel to each longitudinal edge of the front panel (9) there is adjustably mounted a thrust rod (24), each longitudinal edge of the stop plate (15) carries a flange (21), and further there are provided between these parts adjusting elements consisting of studs (25) and slide slots (22).

4. Air vent according to claim 3, characterized by the fact that the studs (25, 55) of the adjusting elements rest on the thrust rods (24, 54), while the oblique slide slots (22, 52) are formed in the flanges (21, 51) of the stop plate (15, 45).

5. Air vent according to claim 4, characterized by the fact that both the front panel (9, 39) and the stop plate (15) consists of a profiled section of U-shaped cross-section, whereby undercut profiled grooves (13, 14, 43, 44) are integrally molded onto the inside surface of the flanges of the front panel (9, 39) as guides for the thrust rods, while the flanges (21 51) of the stop plate (15, 45) contain the oblique slide slots (22, 52).

6. Air vent according to claim 5, characterized by the fact that from the web (10, 40) of the front panel (9, 39) there are stamped the grid apertures (11, 41), while the web (18, 48) of the stop plate (15, 45) is provided on the one hand with protuberances (19, 49) that are pressed out and that fit into the grid apertures (11, 41), and has on the other hand perforations (20, 50) lying beside the protuberances (19, 49) which are shifted relative to the grid apertures (11, 41).

7. Air vent according to claim 6, characterized by the fact that the edges of the protuberances (19, 49) on the stop plate (15, 45) are provided with sealing elements (30) formed of an elastic material.

8. Air vent according to claim 7, characterized by the fact that the thrust rods (24) are connected or connectable (25, 32, 33) at least at one end with slide plate (31) that has a recess for the engagement of a drive crank (36, 37).

9. Air vent according to claim 8, characterized by the fact that the drive crank (36, 37) is mounted (57) in a plate (58) that is adjustable (59, 60) and fixable (61) in a grid aperture (11, 41) of the front panel (9, 39).

10. Air vent according to claim 9, characterized by the fact that the flanges (21, 51) of the stop plate (15, 45) are provided with transverse slots (23) which are engaged by the guide cams (26, 27) resting on the inside surface of the flanges of the front panel (9, 39) as holders.

11. Air vent according to claim 10, characterized by the fact that the guide cams (26) rest on holding shoes (27) that can be pushed into the undercut profiled grooves (13, 14, 43, 44) of the front panel (9, 39) and can be locked therein by means of clamp bolts (28).

* * * * *